US006823835B2

(12) United States Patent
Dunsworth et al.

(10) Patent No.: US 6,823,835 B2
(45) Date of Patent: Nov. 30, 2004

(54) METHOD AND APPARATUS FOR REDUCING LOCOMOTIVE DIESEL ENGINE SMOKE USING SKIP FIRING

(75) Inventors: Vincent F. Dunsworth, Edinboro, PA (US); Eric Richard Dillen, Erie, PA (US); Shawn Michael Gallagher, Erie, PA (US)

(73) Assignee: General Electric Company, Schenectady, NY (US)

( * ) Notice: Subject to any disclaimer, the term of this patent is extended or adjusted under 35 U.S.C. 154(b) by 34 days.

(21) Appl. No.: 10/166,434

(22) Filed: Jun. 10, 2002

(65) Prior Publication Data

US 2002/0195087 A1 Dec. 26, 2002

Related U.S. Application Data

(63) Continuation-in-part of application No. 09/575,337, filed on May 19, 2000, now Pat. No. 6,405,705.

(51) Int. Cl.[7] ..... F02D 17/02
(52) U.S. Cl. ..... 123/305; 123/481
(58) Field of Search ..... 123/481, 198 F, 123/352, 357, 305; 701/104, 105

(56) References Cited

U.S. PATENT DOCUMENTS 4,530,332 A 7/1985 Harvey et al.
4,552,114 A 11/1985 Sano et al.
4,945,869 A 8/1990 Klomp
5,553,575 A 9/1996 Beck et al.
5,826,563 A 10/1998 Patel et al.

FOREIGN PATENT DOCUMENTS

JP 63-154840 A 6/1988

*Primary Examiner*—Andrew M. Dolinar
(74) *Attorney, Agent, or Firm*—Carl A. Rowold; John L. DeAngelis, Jr.; Beusse Brownlee Wulter Mura & Maire, P.A.

(57) ABSTRACT

A diesel engine, having a plurality of individually controllable fuel injected cylinders, is operated in a skip firing mode to reduce smoke emissions during low power operation. The system senses certain identified engine operating parameters and when these parameters exceed predetermined thresholds for a predetermined time, then the skip firing is implemented. In another embodiment, it is possible to implement several different skip firing patterns dependent upon engine performance. Upon implementation of skip firing, the engine timing angle is reset by a fixed angle and a multiplication factor is included in the speed loop integrator to ensure that the appropriate fuel volume value is injected into each cylinder immediately upon initiation of skip firing. Skip firing is then disabled when another set of predetermined conditions is satisfied.

21 Claims, 3 Drawing Sheets

METHOD AND APPARATUS FOR REDUCING LOCOMOTIVE DIESEL ENGINE SMOKE USING SKIP FIRING

This patent application is a continuation-in-part of U.S. patent application Ser. No. 09/575,337 filed on May 19, 2000, now U.S. No. 6,405,705, B1.

BACKGROUND OF THE INVENTION

This invention relates to the control of a diesel engine, and more specifically, relates to the use of skip firing of the engine to reduce smoke emissions.

The technique of eliminating the firing of selected cylinders in an internal combustion or diesel engine is referred to as "skip firing". Removing the fuel supply (and/or spark ignition in a spark ignition engine) from these cylinders prevents them from firing. This technique has been used in the prior art to improve certain aspects of engine performance. When skip firing is initiated, the fuel quantity removed from the skipped cylinders must be added to the firing cylinders so that the performance parameters of the engine are not significantly changed.

Large self-propelled traction vehicles, such as locomotives, typically use a diesel engine to drive a three-phase alternator (having a rotor mechanically coupled to the output shaft of the engine) for supplying electric current to one or more traction motors having rotors drivingly coupled (through speed reducing gearing) to axle-wheel sets of the vehicle. When excitation current is supplied to the field winding of the alternator rotor, alternating voltages are generated in the three-phase stator windings. The three-phase voltages are applied to input terminals of at least one three-phase, bi-directional power rectifier. If the locomotive has DC traction motors, then the rectified voltage is supplied to the parallel connected armature windings of the traction motors via a link. If the locomotive is equipped with AC rather than DC motors, then an inverter is interposed between the power rectifier and the traction motors to supply variable frequency power to the AC motors.

For the purpose of varying and regulating the speed of the diesel engine, it is common practice to equip the engine with a speed regulating governor that adjusts the quantity of pressurized diesel fuel injected into each engine cylinder. In this way, the actual speed (RPM) of the crank shaft is controlled and corresponds to a desired engine speed which is associated with the desired engine horsepower. In a typical electronic fuel injection system, the output signal from the speed regulating governor drives individual fuel injection pumps for each cylinder, thus allowing the controller to individually control the fuel value (i.e., amount of diesel fuel) injected into each cylinder. The desired engine speed and load is set by manually operating a lever or handle on the throttle that can be selectively moved through eight motoring steps or notch positions by the locomotive operator. In addition to the eight power notch positions, the handle has an idle position and several dynamic braking positions. In these dynamic braking positions the traction motors are operated as generators to produce current that is dissipated by passing through resistance banks. These resistance banks are cooled by fans operating at a speed determined by the engine speed.

When not in use, the locomotive is typically parked with its engine running, its throttle in the idle position, and its main alternator developing no power (i.e., because there is zero traction load). However, the typical engine idle speed is set high enough to power all engine-driven auxiliary equipment operative in the idle mode. Further, to conserve fuel, it is also a known practice to reduce engine speed below the regular idle setting (i.e., to a preselected low idle speed) such as 335 RPM (so long as the desired engine performance parameters remain within appropriate tolerance limits). Although the low idle speed conserves fuel and reduces overall stress on the engine, it can also cause excessive smoke generation.

Excessive engine smoke is generally caused by two different diesel engine operating conditions. If the fuel to air ratio is high (i.e., too much fuel relative to the amount of air in the cylinder), excessive smoke is generated because the quantity of air is insufficient to provide complete burning of the fuel. This is especially prevalent at high loads where too much fuel is injected for the quantity of air. This condition also occurs during speed increases until the air quantity has increased to accommodate the higher injected fuel value. Excessive smoke is also caused by poor fuel atomization. The latter cause is prevalent at engine idle and low notch positions.

Fuel injection pressure is critical to smoke formation because fuel injected at higher pressures breaks up or atomizes better as it enters the combustion chamber. Better atomization allows air to mix with the fuel creating a higher localized air-fuel ratio within the cylinder, fostering complete burning and low smoke production. On a specific fuel injection system with a defined pump, nozzle, cam profile, and operating speed, the injection pressure is governed by the injection duration. As the injection duration increases within the cam profile, the injection pressure goes up. Conversely, as the injection duration decreases, the injection pressure decreases. The latter is especially prevalent at engine idle or other unloaded conditions such as dynamic braking. In fact, there are two aspects to idle operation that promote excessive smoke due to low fuel pressure. First, idle conditions are unloaded, so injection durations are very short because the fuel value is very small. Also, idle engine speeds are generally low, which create lower cam velocities. Both conditions significantly reduce the injection pressure, causing an increase in smoke production.

Engine components (cams, bearings, pumps, injectors, etc.) are designed to a maximum peak injection pressure limit. This prevents making mechanical changes to the fuel system to increase idle injection pressure and thereby reduce smoke production, such as, a faster cam profile or smaller injector spray nozzle holes. Such design changes would raise peak injection pressure at all operating points, and at full load (notch 8), the peak injection pressure may exceed design limits.

The recent enactment of environmental statutes and the promulgation of related regulations by the Environmental Protection Agency require reduction in smoke emissions from diesel locomotives. Locomotive manufacturers are therefore directing attention to reducing smoke emissions to comply with these regulations.

It is known that advancing engine timing reduces smoke output by extending the burn time of the fuel as the fuel/air mixture is in a highly compressed state. It is also known that advancing timing increase the formation of NOx, which are also limited by environmental regulations.

BRIEF SUMMARY OF THE INVENTION

The system and method of the present invention overcomes the limitations and disadvantages of the prior art with respect to the production of visible smoke during low power operation of diesel engines, such as when a locomotive is operating in a dynamic braking mode or in an idle state, by skip firing the engine according to the teachings of the present invention when certain operating conditions are satisfied.

Typically dynamic braking throttle positions command a high speed (to produce a high fan speed to dissipate the heat generated by the traction motor generated current as the traction motors operate as generators) but low power requirements because the engine load is low. The higher engine speed produces a higher fuel injector cam speed, but the fuel injection duration is lower because less power is required. The injection duration is so short that just as the fuel pressure is building the injection is terminated. The result is poor fuel atomization and excess smoke. By skip firing the diesel engine, the smoke emissions are reduced. But it is critical to determine the conditions under which skip firing can be implemented without adversely impacting the power required by the various locomotive systems.

Even when the locomotive is parked at idle, certain auxiliary systems load the diesel engine and thus it is required that the engine operate at some minimal power output level during a skip firing period. The present invention also provides an apparatus and method for avoiding engine speed transients caused by the initiation and termination of engine skip firing and for changing the engine timing during the skip firing period.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
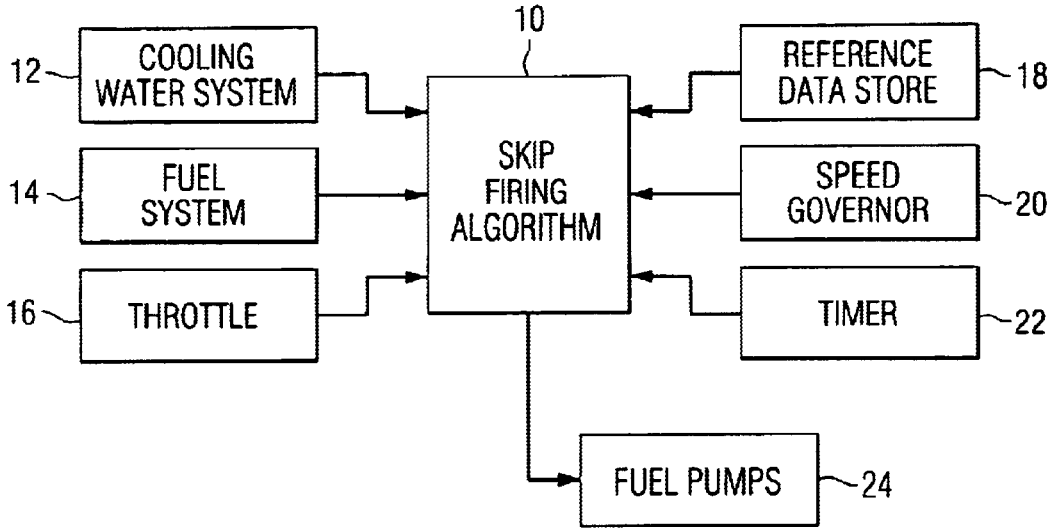
FIG. 1 is an engine controller implemented in accord with the teachings of the present invention.

Before describing in detail the particular skip firing mechanism in accordance with the present invention, it should be observed that the present invention resides primarily in a novel combination of processing steps and hardware related to a method and apparatus for reducing engine smoke using skip firing. Accordingly, these processing steps and hardware components have been represented by conventional processes and elements in the drawings, showing only those specific details that are pertinent to the present invention, so as not to obscure the disclosure with structural details that would be readily apparent to those skilled in the art having the benefit of the description herein.

As is known to those skilled in the art, in a medium-speed diesel locomotive engine, the cylinders are fired sequentially in a prescribed order. The order is determined by the mechanical configuration of the engine. Each cylinder can be fired only at a specific point during the rotation of the engine, and all cylinders fire within two crank shaft revolutions for four stroke engines. Skip firing involves selecting certain cylinders that will not be fired. The teachings of the present invention can also be applied to two stroke engines.

For example, in a conventional operational mode, the cylinders in General Electric V-16 engine (bearing model number 7FDL) are fired in the following order: 1R, 1L, 3R, 3L, 7R, 7L, 4R, 4L, 8R, 8L, 6R, 6L, 2R, 2L, 5R, 5L. The pattern then 5R, 5L. The pattern then repeats. For simplicity in describing the skip firing mode, it is easier to assign a sequential number, 1–16, to each of the cylinders. In this case, the cylinders fire in the order: 1, 2, 3, 4, 5, 6, 7, 8, 9, 10, 11, 12, 13, 14, 15, 16. In this nomenclature, cylinder 1R is equivalent to number 1; cylinder 1L is equivalent to number 2, etc.

One possible skip firing pattern involves firing a cylinder and then skipping the next cylinder. The firing order for this skip firing pattern is: 1, 3, 5, 7, 9, 11, 13, 15, repeat. Because this pattern fires only the right bank of cylinders, it subjects the engine to unbalanced thermal loads. To overcome this problem, the skip firing pattern can be modified to: 1, 3, 5, 7, 9, 11, 13, 15, 2, 4, 6, 8, 10, 12, 14, 16, repeat. Although this skip firing pattern fires all cylinders in two crank shaft revolutions, it has two uneven firings. That is, after cylinder 15, two cylinders are skipped, but no cylinders are skipped after cylinder 16 fires. This skip firing pattern produces slightly uneven running of the diesel engine, although in some applications this may not be objectionable. Because this pattern fires half of the available cylinders during each revolution of the crank shaft, it requires injection of twice as much fuel into the fired cylinders to maintain output horsepower and engine speed.

The number of effective cylinders firing during two revolutions of the crank shaft can be expressed as the product of the total number of cylinders and the number of cylinders fired divided by the number available to be fired. In this case, the effective number of cylinders is: $16\times(8/16)=8$.

Another possible skip fire pattern fires one cylinder then skips two cylinders. This skip firing pattern can be described as follows: 1, 4, 7, 10, 13, 16, 3, 6, 9, 12, 15, 2, 5, 8, 11, 14, repeat. Note that this pattern provides uniform firing and reduces the number of effective cylinders to 5.33. This is calculated as follows: $16\times(1/3)=5.33$. In this embodiment, the amount of fuel injected into each cylinder is increased by a factor of three.

As is known to those skilled in the art, there are nearly an infinite number of skip firing patterns that can be utilized. Further, as is known to those skilled in the art, skip firing patterns can be developed and applied to many different engine types, including V-8 or V-12 engines, straight block engines, and also two stroke engines. The chosen pattern must give due consideration to the particular application, the requirement that cylinders be fired evenly, and vibration and thermal loads induced by the skip firing process. It has been found that the use of skip firing under certain conditions greatly reduces smoke emission at low diesel engine loads. Ancillary benefits of skip firing include the reduction of $NO_x$, CO, HC and particulates. It has also been found that skip firing may produce unacceptable engine vibration at higher engine speeds, and of course may prevent the diesel engine from delivering the required power output under high load conditions.

In the present invention, a method is described wherein skip firing is enabled as a function of certain engine operational parameters, including engine speed and fuel demand (i.e., cubic millimeters of fuel injected into each cylinder during each power stroke). FIG. 1 shows a software block 10, representing the functional software that in response to certain input data initiates and terminates skip firing. The actual implementation of the skip firing method described herein may be in a microprocessor and associated memory within the diesel locomotive. Thus the engine control block 10 may represent a program stored in such memory and operable in such a processor. For instance, the skip firing algorithm of the present invention may be implemented in the engine control system that controls the locomotive diesel engine or in the locomotive control system responsible for control and operation of the entire vehicle. In the latter case, skip firing signals are output from the locomotive control system to the engine control system and then to the fuel injection system for starting and stopping skip firing.

To effectuate the skip firing control scheme of the present invention, certain engine operational information is needed. The cooling water system 12 supplies the coolant water temperature to the engine controller 10. The fuel system 14 provides the current fuel value. The throttle call notch position is provided as an input from a throttle 16, which is typically a handle operated by the locomotive operator to control the diesel engine speed and the power output from the engine alternator for driving the locomotive traction wheels. The throttle also includes one or more engine idle and dynamic brake positions. The software block 10 also requires certain reference data as input from a reference data store 18. This reference data includes a reference speed for each throttle notch position, as well as certain engine operational threshold values selected for use in determining whether to initiate or terminate the skip firing process. Certain of these threshold parameters are unique to a throttle notch position and thus are used by the skip firing algorithm only when the locomotive is operating at that notch position. A speed governor 20 supplies a signal representing the actual engine speed. Finally, a timer 22, which in one embodiment can be internal to the engine controller 10, supplies a clock signal. The result computed by the skip firing algorithm of the present invention causes the software block 10 to send activation signals to the fuel pumps 24 in accordance with the skip firing pattern selected, i.e., the cylinders that are operative and those that are to be skipped when skip firing is initiated.

Figure 2:
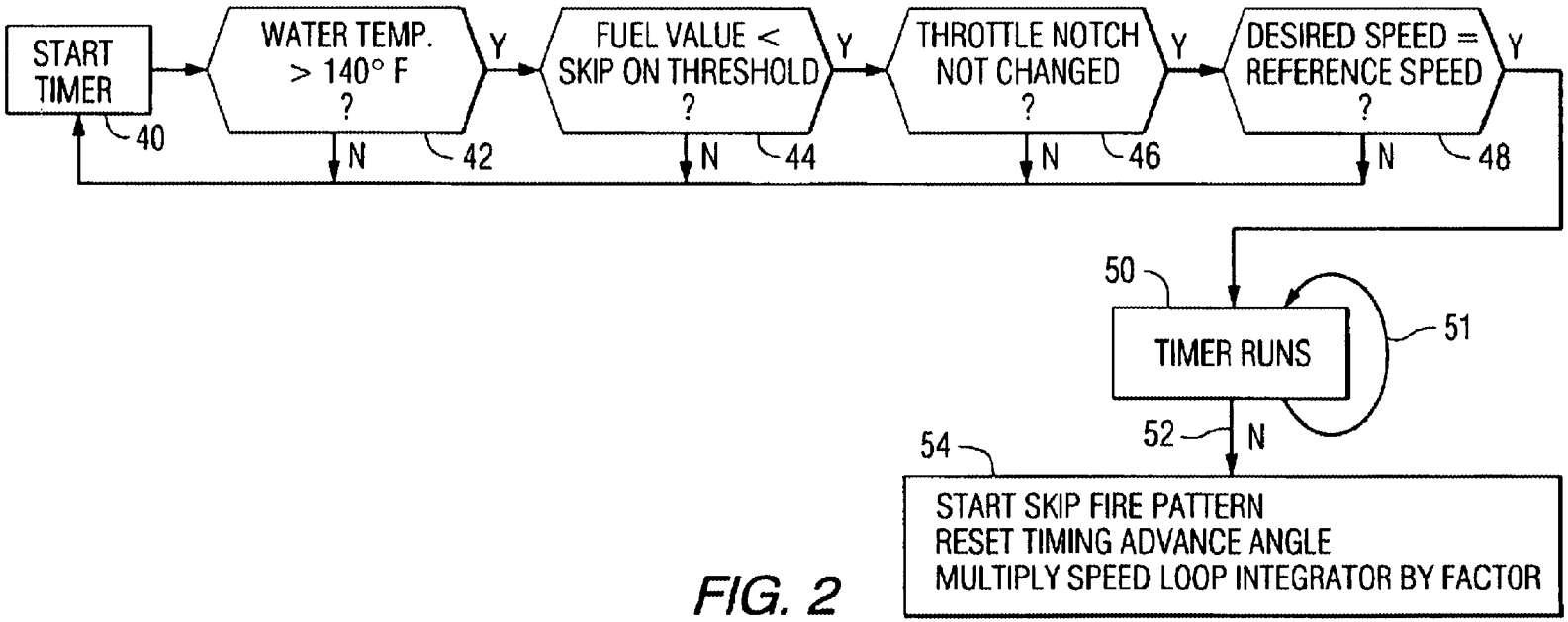
FIG. 2 is a flow chart illustrating the conditions under which skip firing is implemented.

A skip firing algorithm of the present invention, as executed by the software block 10, is illustrated in FIG. 2. The algorithm presents exemplary parametric values for initiating and terminating skip firing. However, it is known that these values are dependent on the diesel engine and locomotive characteristics. Thus other diesel engine models may use different threshold values for the skip firing processes.

At a step 40, the timer 22 is started. The initial value of the timer 22 is established to optimize the reduction of smoke emissions by skip firing the engine if the selected conditions persist for the timer interval, but to prevent the control system from initiating skip firing in response to short term engine transients, i.e., those that do not persist for the timer interval. Absent the timer, these transients can cause the engine to initiate and terminate skip firing for short time periods, which is not necessarily advantageous and can appear as faulty engine operation to the locomotive operator. The specific value for the timer 22 is dependent upon engine characteristics and the specific skip firing pattern to be implemented. Exemplary timer values are in the range of 15 to 45 seconds.

At a step 42, the water temperature is measured to determine whether the temperature is greater than 140° F., i.e., to determine whether the engine is cold. Thus, in one embodiment, other temperature sensors, for example, the oil temperature, can be used in lieu of the water temperature. If this condition is false, skip firing will not be initiated because skip firing a cold engine can interfere with the process of warming up the engine and reaching operating temperature in all cylinders. For example, skip firing a cold engine can cause lacquer formation on the cylinder walls and piston surfaces and uneven temperatures within the cylinder block.

If the temperature sensing decision step 42 produces a false result the engine temperature is too low to initiate skip firing and process execution returns to step 40, where the timer is restarted. If the result of the decision step 42 is true, processing moves to a step 44 where the fuel value (from the fuel system 14) is compared to the skip-on threshold fuel value input from the reference data store 18 as a function of the current notch position. Skip firing is initiated if the fuel value is below the skip-on threshold. This threshold value must be set high enough to ensure that skip firing is initiated at unpowered conditions, but it must be set low enough to prevent skip firing during light loading conditions. If the skip-on threshold is set too high, when skip firing is initiated the fuel demand in the operative cylinders will increase and can exceed the cylinder fuel limit or the skip-off threshold. Also, the margin between the skip-on and skip-off thresholds must be sufficiently large to avoid toggling between skip-on and skip-off. That is, when skip firing is initiated, the fuel value in the operative cylinders will increase, but that fuel value must not exceed the skip-off threshold, otherwise the engine will immediately revert to normal operation. But, if the skip-off threshold is set too high, then the excess fuel in the operative cylinders can cause the engine to bog. As a result, these fuel value skip-on and skip-off thresholds will vary dependent upon the application in which the present invention is employed and the engine and locomotive characteristics. In one embodiment the skip-on threshold is about 180 $mm^3$ of fuel.

If the fuel value is above the skip-on threshold, then the result of the decision step 44 is false and processing returns to the start timer step 40. If the result of the fuel value decision step 44 is true, processing moves to a decision step 46 to determine whether the throttle notch handle position has changed since the timer was started. The purpose of this decision step is to prevent skip firing during engine accelerations when more fuel is needed to accelerate the engine. Also, engine accelerations usually indicate load applications, during which skip firing should not be initiated. In one embodiment of the present invention only increasing throttle notch positions are monitored by the decision step 46. Downward notch position changes can momentarily reduce the fuel demand to zero, but would not initiate skip firing alone because the duration of the near-zero fuel demand would be less than the timer interval.

If the result from the decision step 46 is false, processing moves back to the start timer step 40. If the result is true, processing moves to a decision step 48 where the desired engine speed (as determined by the position of the throttle) is compared to a reference speed. Typically, the process identified by the decision step 48 is performed in the electronic governing unit speed regulator, which regulates the engine speed by determining the fuel value to be injected into each cylinder based on the difference between a reference engine speed and the actual engine speed. If the decision step 48 returns a false result, processing returns to the start timer step 40, as it is not beneficial to implement skip firing while the diesel engine is accelerating to reach the desired speed.

If the decision step 48 returns a true value then the diesel engine is operating at a steady-state speed (i.e., not in a transient condition) and processing moves to a step 50, indicating the continual running of the timer 22. Although not shown in FIG. 2, during the timing sequence indicated by the step 50 the process returns to the decision steps 42, 44, 46 and 48 at predetermined intervals. Thus, if any one of the decision steps 42, 44, 46 and 48 produces a negative result when checked, the process returns to the start timer step 40.

A branch 51 exiting and entering the step 50 indicates the running of the timer until the preset value is reached. In one embodiment the timer is a count down timer that is set to a predetermined positive value at the step 40 and counts down to the preset zero value. In another embodiment the counter operates in a count up mode, counting up from zero to the predetermined value. If the timer reaches the preset value, then the process exits the step 50 via a branch 52 and enters a step 54 where the skip firing pattern is initiated by controlling fuel injection through the signal sent to the fuel pumps 24.

As is known to those skilled in the art, there are other techniques for implementing the concepts expressed in the flowchart. In one embodiment, the timer interval is 30 seconds. That is, if the timer operates in a count down mode, the initial value is set at 30 seconds and the timer expires when zero is reached. If the timer operates in a count up mode, the timer begins at zero and expires when the 30 seconds count is reached.

In summary, in one embodiment all of the operating conditions set forth in the FIG. 2 flow chart must have existed for a duration greater than the time interval established by the timer.

As shown at the step 54, in addition to starting the skip firing process, the engine timing angle is changed by a predetermined value. The engine timing angle is defined as the interval (as measured in degrees, where a complete cycle is 360°) between the time when the piston reaches the top dead center of its stroke and the initiation of fuel injection, as measured in degrees of a circle. For example, if the timing angle is 0° then the piston reaches top-dead-center simultaneously with the fuel injection. A timing angle of 2° is an advance angle and thus the piton reaches top dead center 2° before fuel injection. Negative timing angle values represent a timing retard.

With respect to diesel engine operation, it is generally known that retarding the engine timing angle reduces $NO_x$ and particulate emissions and advancing the engine timing angle reduces smoke. Thus, to further reduce engine smoke emissions during the skip firing process the engine timing angle can be advanced. However, this is not necessarily required in all skip firing applications and situations. As discussed above, smoke is caused by the injection of a relatively small fuel value into a cylinder. Since the fuel values are relatively small at idle and in the dynamic braking notch positions, skip firing can be initiated to increase the fuel value injected into each operating cylinder, thereby decreasing smoke emissions. To further decrease the smoke emissions, the engine timing angle can also be advanced. If however, the skip firing process alone reduces the smoke below a desired limit, then it is not necessary to advance the engine timing. In fact, under some operating conditions it may be possible to retard the engine timing during skip firing to reduce the $NO_x$, while still maintaining the smoke at acceptable levels. The actual retard angle can be established as a constant that is implemented whenever the engine is skipped fired, or a table of retard timing angles can be provided, with the operative value selected based on predetermined operating conditions.

Figure 3:
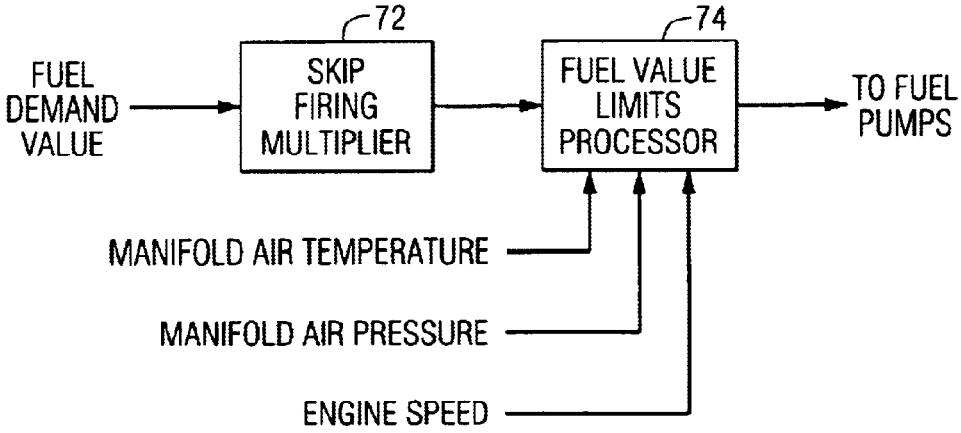
FIG. 3 illustrates a speed regulator associated with the present invention.

The step 54 also indicates that when skip firing is implemented, the speed loop integrator is multiplied by a factor. This aspect of the present invention is illustrated in FIG. 3. As discussed above, the engine governing unit speed regulator compares the actual diesel engine speed with a reference speed to generate a speed error signal, which in turn generates a fuel demand signal for controlling the injection pumps. Based on the error signal, the electronic governing unit speed regulator adjusts the fuel demand value cylinder-by-cylinder in a direction to reduce the error signal to zero. However, when the engine goes into the skip firing mode, the engine speed will immediately drop because fewer cylinders are firing. As a result, the error signal indicates an increased error and the electronic governing unit speed regulator demands injection of more fuel into the operating cylinders to bring the error signal to zero. However, this feedback control loop has a non-zero time constant and some considerable time may elapse before the actual speed equals the reference speed. The In accordance with the present invention, and to avoid this lag time, when skip firing is initiated the electronic governing unit speed regulator immediately adjusts the fuel demand value by multiplying the fuel demand value by the ratio of number of available cylinders divided by the number of cylinders firing per crank shaft cycle. For example, if only half of the available cylinders are firing during a skip firing crank shaft cycle, the effective ratio is two. The skip firing multiplier 72 (see FIG. 3) multiplies the fuel value by two, thereby reducing the time for the speed regulator to produce a zero error signal. If, in a more complex embodiment, more than one skip firing pattern is available for use by the locomotive, each pattern will have a unique multiplier based on the number of firing and skipped cylinders. Further, in another embodiment, the actual multiplier value may vary slightly from the effective ratio, as friction and other operational factors can be considered in calculating the multiplier value.

Returning to FIG. 3, the fuel demand value after multiplication is input to a fuel value limits processor 74, for determining the fuel value limit based on the manifold air temperature, the manifold air pressure and engine speed and determining if the multiplied fuel value exceeds that limit. See, for example, commonly owned patent application entitled "Variable Fuel Limit for Diesel Engine" filed on Sep. 25, 2000 and bearing application Ser. No. 09/669,999. The fuel value limits processor 74 is operative to set a maximum limit for the fuel value to avoid engine overfueling. The output from the fuel value limits processor 74 is the fuel value that is input to the fuel pumps for controlling injection within the engine cylinders.

Figure 4:
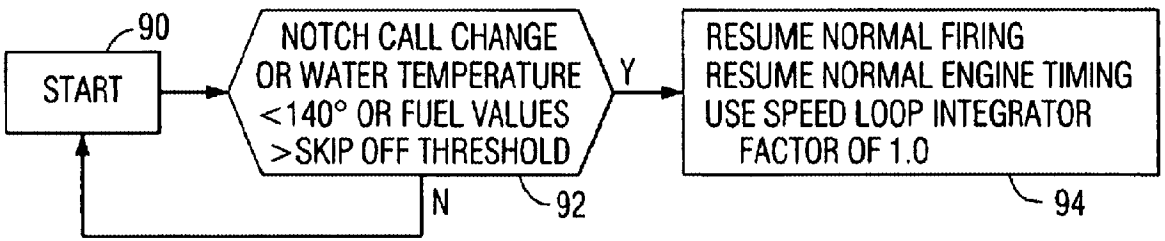
FIG. 4 is a flow chart illustrating the conditions under which skip firing is discontinued.

The algorithm for discontinuing skip firing is illustrated in FIG. 4. The algorithm is operative in an interpret mode at predetermined intervals while the engine is operating in skip firing. The algorithm begins at a start step 90 and proceeds to a decision step 92. The conditions under which skip firing is terminated, as evaluated at the decision step 92, are as follows: a change in the throttle notch call, or the water temperature drops below 140° F., or the fuel value exceeds the skip-off threshold value. The skip off threshold value is determined first noting that injecting an excessively high fuel value in a cylinder can overstress the engine components. Thus there is an established fuel value limit for the engine and fuel values in excess of this limit are not permitted. Since skip firing injects more fuel into the operative cylinders than would otherwise be injected during normal operation, the skip-off threshold must be established to ensure that the fuel values during skip firing remain below the fuel value limit. Also, the skip-off threshold is set to ensure that skip firing is terminated for load applications, that is, when the engine load increases. Recall that skip firing is a technique implemented during relatively low load conditions and thus it is not intended for loaded operation of the diesel engine. If any one of these conditions is satisfied, processing moves from the decision step 92 to a step 94 where the normal firing pattern is resumed, the engine timing value is changed to its normal value, and a value of one is now used as a multiplier in the skip firing multiplier 72. If none of the three conditions set forth at the decision step 92 is satisfied, the skip firing operation is maintained and at the next interrupt interval the process returns to the start step 90.

Figure 5:
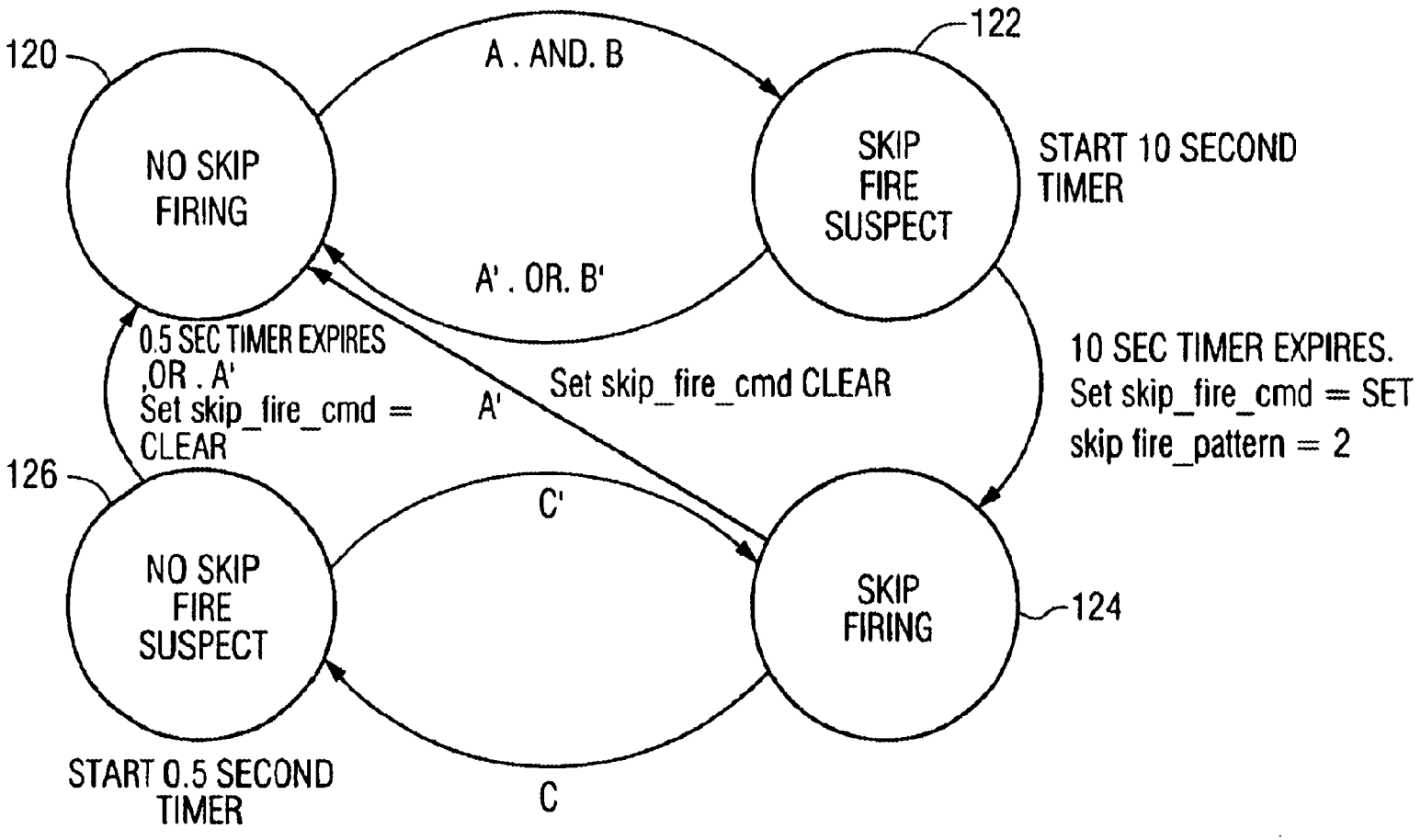
FIG. 5 is a state diagram illustrating operation of a second embodiment of the present invention.

FIG. 5 illustrates another embodiment of the present invention where the skip firing algorithm is initiated without throttle notch position information. The operative state in the state diagram of FIG. 5 is dependent upon certain conditions, referred to therein as conditions A, B, and C, described as follows. Condition A requires the following:

Pop test=not active, AND

Water temp greater than 140° F. AND

State=traction alternator not supplying power.

The first requirement for satisfying condition A is the pop test in an inactive mode. The pop test is initiated to test the firing of each cylinder. It is executed by injecting a greater than normal amount of fuel into each cylinder. When the cylinder fires, a "pop" sound is heard, indicating that the cylinder is firing properly.

The second required condition for satisfying condition A is a water temperature above 140° F. The third required condition is satisfied when it is known that the traction alternator is not supplying power. Dependent upon the locomotive control system, there are a variety of techniques for determining this state. For example, when the dynamic brakes are applied and the DC link power is being supplied by the traction motors, and no link power is being supplied by the engine, the locomotive is in a non-powered state.

Condition B involves the engine speed in revolutions per minute and the fuel value. In one embodiment, to satisfy condition B, the desired engine speed must be less than the actual engine speed plus 20, and the fuel value must be less than 25 percent of the fuel value limit.

Condition C also relates to the engine speed (in revolutions per minute) and the fuel value. Condition C is satisfied when the desired number of engine revolutions per minute is greater than the actual number of revolutions per minute plus 20 or when the fuel value is greater than 50 percent of the fuel value limit.

The locomotive controller implementing the state diagram of FIG. 5 includes a skip fire option setting. If the option is not set, then the state machine will not execute and therefore skip firing will not be initiated. Instead, the state machine will remain at a state 120 where there is no skip firing. If conditions A and B are satisfied, execution moves to a state 122 where skip firing may be a viable option. At the state 122, a ten second timer is started. If the system remains at the state 122 for the entire timer duration, then the skip fire command is set and the diesel engine fuel injectors are controlled to implement one of the skip fire patterns discussed above. The implementation of skip firing is shown at a state 124. Returning to the state 122, if during the timer duration both of the conditions A and B are not satisfied, then the machine returns to the state 120. This situation is illustrated by the branch connecting the state 122 with the state 120 labeled NOT A (A') or NOT B (B').

Skip firing continues at the state 124 until condition NOT A occurs. If this happens, the skip fire command is cleared. If the condition C is satisfied while the system is at the skip firing step 124, then the system moves to state 126 where a further evaluation is made as to whether skip firing should be continued. At the state 126, in one embodiment a half-second timer is started. If that timer expires or condition NOT A is satisfied, then the skip fire command is cleared and skip firing terminates. If, however, while the system is at the state 126, a NOT C condition occurs, then the system returns to the skip firing state 124. Note that, for instance, a NOT C condition requires both of the statements associated with condition C to be false.

While the invention has been described with reference to a preferred embodiment, it will be understood by those skilled in the art that various changes may be made and equivalent elements may be substituted for elements thereof without departing from the scope of the invention. In addition, modifications may be made to adapt a particular situation to the teachings of the invention without departing from the essential scope thereof. Therefore, it is intended that the invention not be limited to the particular embodiment disclosed as the best mode contemplated for carrying out this invention, but that the invention include all embodiments falling within the scope of the appended claims. For example, the invention may be applied to marine or automotive internal combustion engines. Further, application of the invention described herein is not limited to a specific engine size or cylinder count. It is also applicable to both four stroke and two stroke engines, and can be expanded by the use of different skip firing patterns under different conditions to further optimize performance.

What is claimed is:

1. A method for selectively operating a locomotive powered by a diesel engine in a skip firing mode, wherein control of the diesel engine is provided by a discrete-position throttle, and wherein the engine includes a plurality of individually controllable cylinders, the method comprising:

(a) during a predetermined time interval, determining the relationship between selected engine operating parameters and a predetermined reference value for each of the selected engine operating parameters;

(b) determining whether the throttle has been moved from a first to a second discrete position during the predetermined time interval; and (c) in response to steps (a) and (b) implementing a skip firing pattern for the cylinders.

2. The method of claim 1 wherein the diesel engine further comprises a cooling water system, and wherein fuel having a fuel value is injected into each one of the cylinders during operation of the diesel engine, wherein the selected engine operating parameters are selected from among: a diesel engine cooling water temperature, a diesel engine temperature, a fuel value and a diesel engine speed.

3. The method of claim 1 wherein the diesel engine further comprises a cooling water system, and wherein the step (a) further comprises at least determining whether a cooling water temperature is greater than approximately 140° F.

4. The method of claim 1 wherein step (a) further comprises at least determining whether a temperature of the diesel engine is greater than a predetermined value.

5. The method of claim 1 wherein fuel having a fuel value is injected into each one of the cylinders during operation of the diesel engine, and wherein the step (a) further comprises at least determining a relationship between the fuel value and a fuel value skip-on threshold.

6. The method of claim 1 wherein fuel having a fuel value is injected into each one of the cylinders during operation of the diesel engine, and wherein the step (a) further comprises at least determining whether the fuel value is less than a fuel value skip-on threshold.

7. The method of claim 1 wherein the predetermined time interval is selected to avoid initiation of the skip firing mode in response to transients in one or more engine operating parameters.

8. The method of claim 1 wherein the step (a) further comprises at least determining whether a desired engine speed is approximately equal to a reference speed.

9. The method of claim 1 wherein the step (a) comprises at least determining whether the diesel engine is accelerating.

10. The method of claim 1 wherein the diesel engine operates at an engine timing angle, further comprising a step (d) changing the engine timing angle.

11. The method of claim 10 wherein the step (d) further comprises retarding the engine timing angle.

12. The method of claim 1 further comprising a step (d) terminating engine skip firing when during a predetermined time interval selected engine operating conditions have a predetermined relationship with predetermined reference values.

13. The method of claim 12 wherein the diesel engine further comprises a cooling water system, and wherein fuel having a fuel value is injected into each one of the cylinders during operation of the diesel engine, wherein the selected engine operating parameters are selected from among: a diesel engine cooling water temperature, a diesel engine temperature, a fuel value and a diesel engine speed.

14. The method of claim 1 wherein the step (c) further comprises inhibiting fuel injection to selected cylinders.

15. The method of claim 1 wherein the step (c) further comprises multiplying a fuel value representing a quantity of fuel injected into each cylinder by a factor representing a total number of cylinders in the engine compared with a total number of cylinders firing in accordance with the skip firing pattern.

16. The method of claim 1 wherein the step (c) further comprises including a fuel value multiplication factor in an engine speed control loop that controls the plurality of cylinders.

17. A method for selectively operating a locomotive powered by a diesel engine in a skip firing mode, wherein control of the diesel engine is provided by a discrete-position throttle, and wherein the engine includes a plurality of individually controllable cylinders, the method comprising:

(a) determining that the engine is operating in a steady state condition during a predetermined time interval;

(b) determining whether the throttle has been moved from a first to a second discrete position during the predetermined time interval;

(c) in response to steps (a) and (b):

(c1) implementing a skip firing pattern for the cylinders; and (c2) including a multiplication factor in the engine speed control loop.

18. A method for selectively operating a locomotive powered by a diesel engine in a skip firing mode, wherein the engine includes a plurality of individually fuelable cylinders, wherein the diesel engine is cooled by cooling water and drives a traction alternator for supplying motive power to the locomotive, the method comprising:

implementing skip firing if a first engine operating condition is in a first predetermined state for a first predetermined time and if a second engine operating condition is in a second predetermined state for the first predetermined time, wherein the first engine operating condition comprises a cylinder firing test having an active state or an inactive state, a determination of a temperature of the cooling water and a determination of whether the engine traction alternator is supplying motive power, and wherein the first operating condition is in the first state when the cylinder firing test is in the inactive state, the temperature of the cooling water is greater than a predetermined value and the traction alternator is not supplying motive power;

terminating skip firing when either the first engine operating condition is not in the first predetermined state or when the second engine operating condition is not in the second predetermined state; and terminating skip firing if a third engine operating condition is in a third state for a second predetermined time.

19. An apparatus for selectively operating a locomotive powered by a diesel engine in a skip firing mode, wherein control of the diesel engine is provided by a discrete-position throttle, and wherein the engine includes a plurality of individually fuelable cylinders, the apparatus comprising:

sensors for ascertaining selected engine operating conditions;

a comparator for determining that each selected operating condition has a predetermined relationship with a predetermined reference value for a predetermined time;

a module for determining whether the throttle has been moved from a first to a second position during the predetermined time; and a controller for implementing a skip firing pattern by terminating fuel delivery to a number of the plurality of cylinders while the remaining cylinders continue operating, for changing the engine timing angle and for increasing the fuel delivered to the operating cylinders of the plurality of cylinders.

20. The apparatus of claim 19, wherein the diesel engine operates at an engine timing angle, and wherein the controller retards the engine timing angle.

21. The apparatus of claim 19 wherein the controller increases fuel delivered to the operating cylinders of the plurality of cylinders in relation to the number of the plurality of cylinders to which fuel delivery has been terminated.

* * * * *